US006856096B1

(12) United States Patent
Choudhury

(10) Patent No.: US 6,856,096 B1
(45) Date of Patent: Feb. 15, 2005

(54) BALLAST WITH LOAD-ADAPTABLE FAULT DETECTION CIRCUIT

(75) Inventor: Ayan Kumar Choudhury, Haryana (IN)

(73) Assignee: Osram Sylvania, Inc., Danvers, MA (US)

( * ) Notice: Subject to any disclaimer, the term of this patent is extended or adjusted under 35 U.S.C. 154(b) by 0 days.

(21) Appl. No.: 10/674,144

(22) Filed: Sep. 29, 2003

(51) Int. Cl.[7] ..... H05B 37/00

(52) U.S. Cl. ..... 315/119; 315/127; 315/128; 315/DIG. 7

(58) Field of Search ..... 315/127, DIG. 5, 315/DIG. 7, 219, 119, 128

(56) References Cited

U.S. PATENT DOCUMENTS 4,893,059 A * 1/1990 Nilssen ..... 315/127
4,939,427 A * 7/1990 Nilssen ..... 315/209 R

* cited by examiner

*Primary Examiner*—David Vu
(74) *Attorney, Agent, or Firm*—Kenneth D. Labudda

(57) ABSTRACT

A ballast (10) for powering a gas discharge lamp load (30) comprises an inverter (100), an output circuit (200), and a fault detection circuit (300). During operation, fault detection circuit (300) monitors a first signal and a second signal within output circuit (300) and sets a fault threshold in dependence on the second signal. The second signal is indicative of the type of lamps in the load (30). In response to the first signal exceeding the fault threshold, fault detection circuit (300) issues a shutdown command directing the inverter (100) to cease operation.

15 Claims, 2 Drawing Sheets

BALLAST WITH LOAD-ADAPTABLE FAULT DETECTION CIRCUIT

FIELD OF THE INVENTION

The present invention relates to the general subject of circuits for powering discharge lamps. More particularly, the present invention relates to a ballast with a fault detection circuit that adapts to the lamp load.

BACKGROUND OF THE INVENTION

Many electronic ballasts for powering gas discharge lamps include a driven half-bridge inverter and a series resonant output circuit. Such ballasts generally include some form of protection circuitry for preventing damage to the inverter and other portions of the ballast in the event of a lamp fault condition. Common lamp fault conditions include lamp removal or lamp failure.

A popular protection approach is to place a current-sensing resistor in series with the lower inverter transistor, monitor the voltage across the current-sensing resistor, and shut down the inverter if the voltage across the current-sensing resistor exceeds a predetermined threshold value. While this approach is adequate for protecting against certain fault conditions, such as lamp removal or lamp failure, it does not adequately protect against less well-defined fault conditions, such as the arcing that occurs when a slight air gap is introduced between the pins of a lamp and the sockets of the lighting fixture. Under such an emergent arcing situation, the voltage that develops across the current-sensing resistor will not necessarily be high enough to exceed the predetermined threshold value, in which case the inverter will continue to operate and the potentially dangerous arcing condition will be allowed to continue unabated.

Simply lowering the resistance of the current-sensing resistor (and, thus, the predetermined threshold value) is not a successful remedy to this problem, because that might result in the inverter being improperly shut down even in the absence of a legitimate fault condition. This is especially true for ballasts that must be capable of powering several different types of lamps (e.g., F17T8, F25T8, and F32T8 lamps), in which case the current that flows through the current-sensing resistor during normal operation (i.e., with no fault condition present) may vary over a considerable range. Thus, in order to avoid false detection of a fault, the predetermined threshold value must be set such that the current through the current-sensing resistor must be much higher than the normal operating value before a fault is detected. Of course, when a mild arcing condition occurs, the current that flows through the current-sensing resistor may increase only modestly above its normal operating value, in which case the predetermined fault threshold will not be reached and the inverter be allowed to continue to operate.

What is needed, therefore, is a ballast with a fault detection circuit that is capable of quickly and accurately responding to an arcing condition in the lamp load. Such a ballast would represent a significant advance over the prior art.

DETAILED DESCRIPTION OF THE PREFERRED EMBODIMENTS

Figure 1:
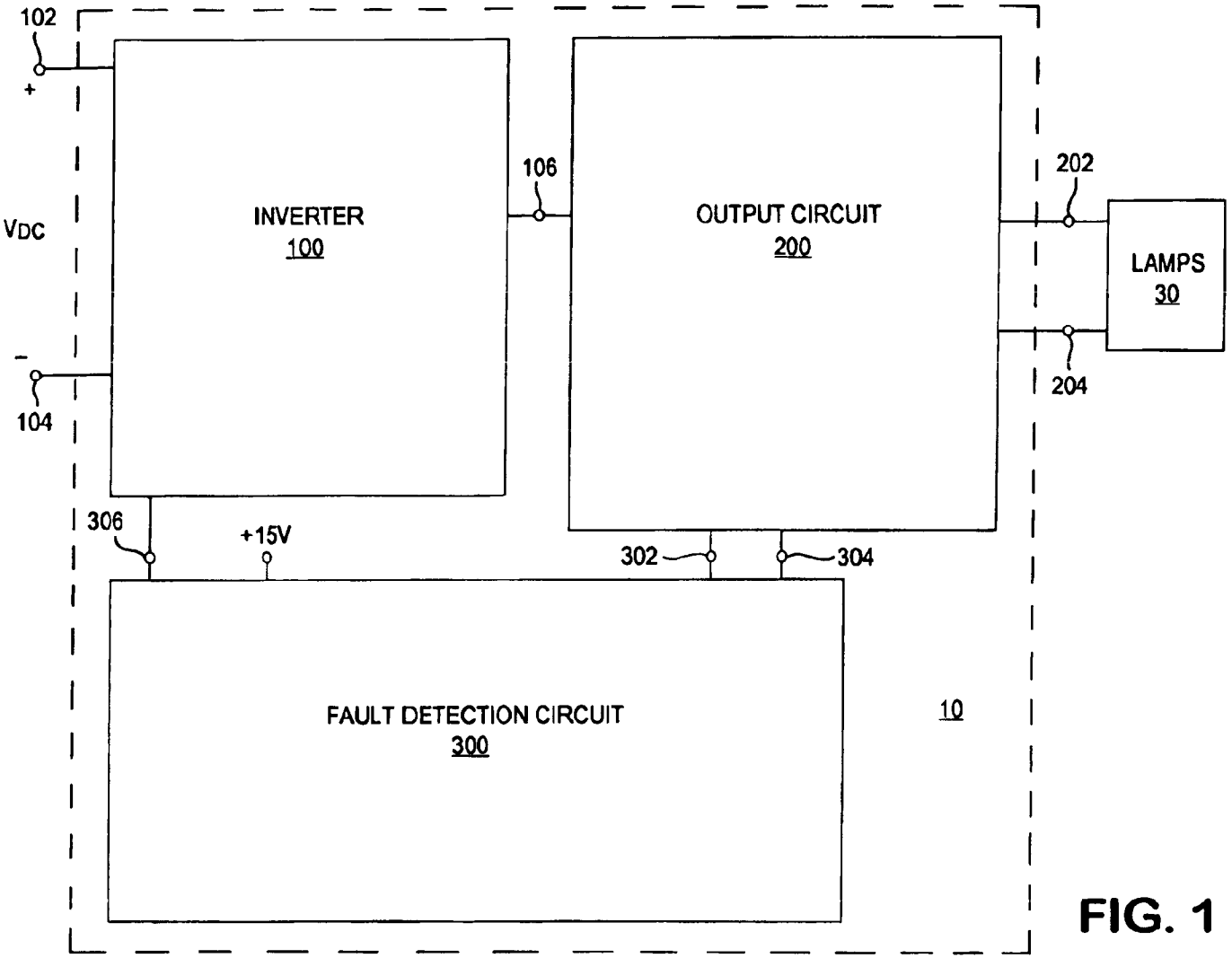
FIG. 1 is a partial block-diagram schematic of a ballast with a fault detection circuit, in accordance with a preferred embodiment of the present invention.

In a preferred embodiment of the present invention, as described in FIG. 1, a ballast 10 includes an inverter 100, an output circuit 200, and a fault detection circuit 300.

Inverter 100 comprises first and second input terminals 102,104 and an inverter output terminal 106. Input terminals 102,104 receive a source of substantially direct-current (DC) voltage, $V_{DC}$. $V_{DC}$ may be provided by any of a number of arrangements known to those skilled in the art; one such arrangement consists essentially of a full-wave rectifier (coupled to a source of conventional 60 hertz alternating current) followed by a boost converter.

Output circuit 200 is coupled to inverter output terminal 106 and includes first and second output connections 202, 204 for coupling to a lamp load 30 comprising at least one gas discharge lamp.

Fault detection circuit 300 is coupled between output circuit 200 and inverter 100. During operation, fault detection circuit 300 monitors a first signal and a second signal within output circuit 200, and sets a fault threshold in dependence on the second signal. In response to the first signal exceeding the fault threshold, fault detection circuit 300 issues a shutdown command directing inverter 100 to cease operation. Preferably, the second signal is indicative of the type of lamps (e.g., F32T8, F25T8, F17T8) in the load. Thus, fault detection circuit 300 is load-adaptable.

Preferably, during operation of fault detection circuit 300, the fault threshold is set at a first level in response to the second signal being less than a first predetermined value. The fault threshold is set at a second level that is greater than the first level in response to the second signal being greater than the first predetermined level but less than a second predetermined level. The fault threshold is set at a third level that is greater than the second level in response to the second signal being greater than the second predetermined level.

For example, if ballast 10 is designed to accommodate the three most common types of T8 lamps (e.g., F32T8, F25T8, and F17T8), the second signal will be less than the first predetermined level when lamp load 30 consists of one or more F17T8 lamps. The second signal will be greater than the first predetermined level but less than the second predetermined level when lamp load 30 consists of one or more F25T8 lamps. The second signal will be greater than the second predetermined level when lamp load 30 consists of F32T8 lamps. Thus, the fault threshold is set in dependence on the type of lamps in lamp load 30.

As described in FIG. 1, fault detection circuit 300 includes first and second inputs 302,304 coupled to output circuit 200, and an output 306 coupled to the inverter. The first signal in output circuit 200 is monitored via first input 302. The second signal in output circuit 200 is monitored via second input 304. In the event of a fault condition, the shutdown command is sent to inverter 100 via output 306. Fault detection circuit 300 also receives a direct current (DC) voltage supply, depicted as "+15 V" in FIG. 1, that provides low voltage (i.e., 15 volts) operating power for circuit 300.

Figure 2:
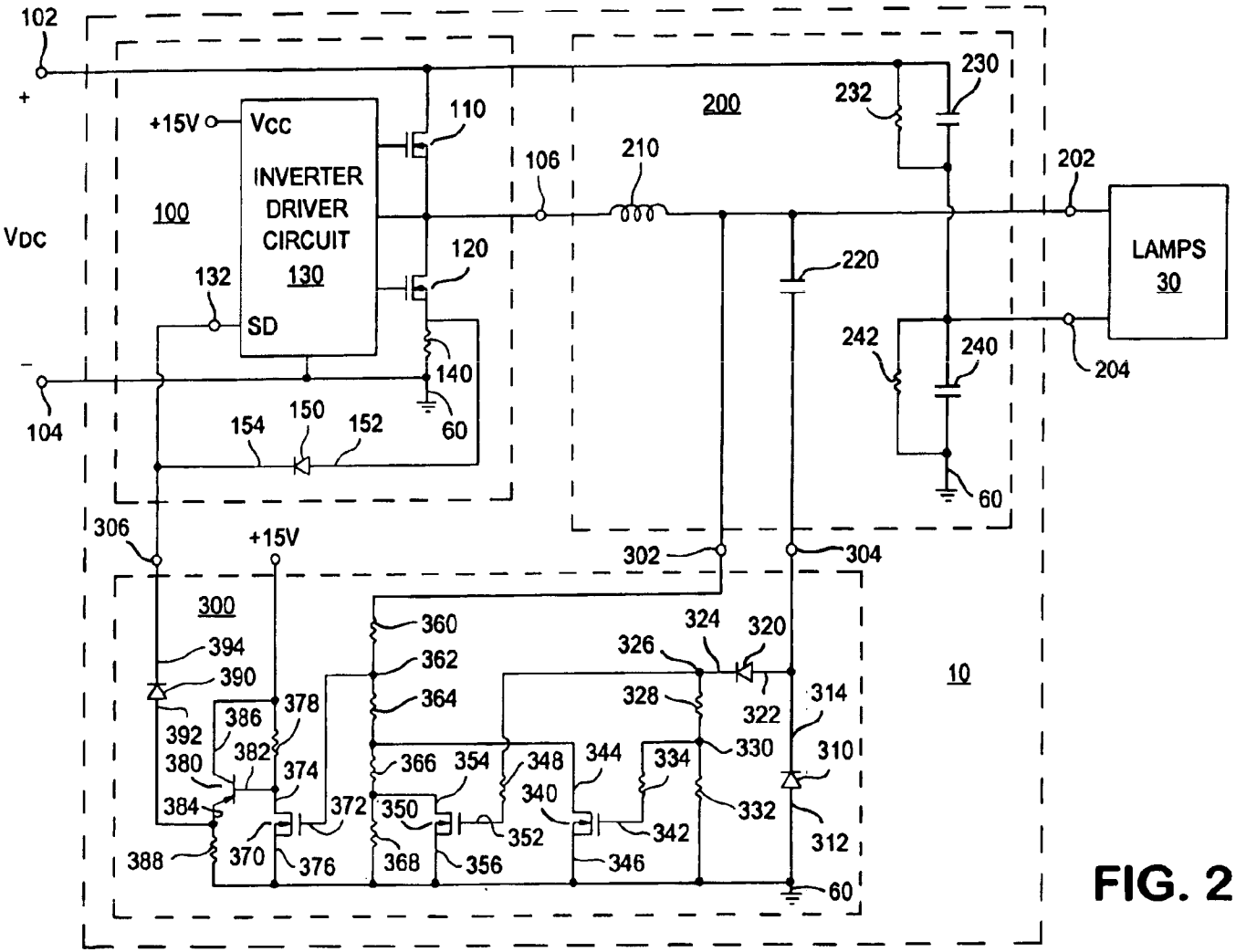
FIG. 2 is a detailed schematic of a ballast with a fault detection circuit, in accordance with a preferred embodiment of the present invention.

Turning now to FIG. 2, in a preferred embodiment of ballast 10, inverter 100 is implemented as a half-bridge type inverter that includes upper and lower inverter transistors 110,120 and an inverter driver circuit 130. Inverter driver circuit 130 is coupled to inverter transistors 110,120 and includes a shutdown (SD) input 132 that is coupled to output 306 of fault detection circuit 300. During operation, inverter driver circuit 130 commutates inverter transistors 110,130 in a substantially complementary manner (such that, when transistor 110 is on, transistor 120 is off, and vice versa). If, however, a shutdown command (e.g., +15 volts) is received at shutdown input 132, inverter driver circuit 130 will cease commutating inverter transistors 110,120. Inverter driver circuit 130 also includes a supply input ($V_{CC}$) for receiving operating power from the DC voltage supply (+15 V). Inverter driver circuit 130 may be realized by any of a number of suitable circuits that are well known to those skilled in the art of electronic ballasts. For example, inverter driver circuit 130 may be realized using the L6570G integrated circuit (manufactured by ST Microelectronics), along with associated peripheral components.

As described in FIG. 2, inverter 100 further comprises a current sensing resistor 140 and a diode 150. Current sensing resistor 140 is coupled in series with lower inverter transistor 120. Diode 150 has an anode 152 coupled to current sensing resistor 140 and a cathode coupled to the shutdown input 132 of inverter driver circuit 130. The function of diode 150 is to isolate current sensing resistor 140 from the circuitry within fault detection circuit 300.

As is known in the prior art, current sensing resistor 140 monitors the current that flows through lower inverter transistor 120 and, in response to that current exceeding a predetermined threshold (e.g., such as what occurs under a no load fault condition wherein lamp load 30 is completely disconnected from output connections 202,204), provides a voltage at shutdown input 132 that is sufficient (e.g., several volts or so) to cause inverter driver circuit 130 to cease inverter switching. However, as alluded to in the Background of the Invention, current sensing resistor 140 alone is not sufficient for protecting against less well-defined fault conditions, such as the arcing that occurs when a lamp is being disconnected from lamp load 30 and/or output connections 202,204. Hence the need for fault detection circuit 300.

As described in FIG. 2, output circuit 200 further includes a resonant inductor 210, a resonant capacitor 220, an upper half-bridge capacitor 230, an upper half-bridge resistor 232, a lower half-bridge capacitor 240, and a lower half-bridge resistor 242. Resonant inductor 210 is coupled between inverter output terminal 106 and first output connection 202. Resonant capacitor 220 is coupled between first output connection 202 and the second input 304 of fault detection circuit 300. Upper half-bridge capacitor 230 and upper half-bridge resistor 232 are each coupled between the first input terminal 102 of inverter 100 and second output connection 204. Lower half-bridge capacitor 240 and lower half-bridge resistor 242 are each coupled between second output connection 204 and circuit ground 60.

The operation of output circuit 200 is understood by those skilled in the art, and will thus not be elaborated upon in detail herein. However, the following should be appreciated:

(1) The voltage across resonant capacitor 220 will increase substantially in response to an arcing condition within lamp load 30. Thus, it is preferred that the voltage across resonant capacitor 220, or at least a voltage that is indicative thereof, is the first signal that is monitored by fault detection circuit 300. Correspondingly, first input 302 is coupled to first output connection 302.

(2) During normal operation of lamp load 30 (i.e., when no fault condition is present), the voltage across resonant capacitor 220 will be different for different lamp loads. For example, the normal operating voltage across resonant capacitor 220 will be highest when lamp load 30 consists of F32T8 lamps, and will be lowest when lamp load 30 consists of F17T8 lamps.

(3) The current that flows through resonant capacitor 220 provides an indicator of the type of lamps that are present within lamp load 30. More particularly, the current that flows through resonant capacitor 220 will increase with the power consumed by lamp load 30; for example, the current through resonant capacitor 220 will be greatest when lamp load 30 consists of F32T8 lamps, and will be least when lamp load 30 consists of F17T8 lamps. Thus, it is preferred that the current that flows through resonant capacitor 220, or at least a current that is indicative thereof, is the second signal that is monitored by fault detection circuit 300. Correspondingly, second input 304 is coupled in series with resonant capacitor 220.

Referring again to FIG. 2, in a preferred embodiment of ballast 10, fault detection circuit further comprises a first diode 310, a second diode 320, a first resistor 328, a second resistor 332, a first transistor 340, a third resistor 334, a second transistor 350, a fourth resistor 348, a fifth resistor 360, a sixth resistor 364, a seventh resistor 366, an eighth resistor 368, a third transistor 370, a ninth resistor 378, a fourth transistor 380, a tenth resistor 388, and a third diode 390. First diode 310 has an anode 312 coupled to circuit ground and a cathode 314 coupled to second input 304. Second diode 320 has an anode 322 coupled to second input 304 and a cathode 324 coupled to a first node 326. First resistor 328 is coupled between first node 326 and a second node 330. Second resistor 332 is coupled between second node 330 and circuit ground 60. First transistor 340 has a gate 342, a drain 344, and a source 346; source 346 is coupled to circuit ground 60. Third resistor 334 is coupled between second node 330 and gate 342 of first transistor 340. Second transistor 350 has a gate 352, a drain 354, and a source 356; source 356 is coupled to circuit ground 60. Fourth resistor 348 is coupled between first node 326 and gate 352 of second transistor 350. Fifth resistor 360 is coupled between first input 302 and a third node 362; although depicted in FIG. 2 as a single resistor, it should be appreciated that, for purposes of not exceeding component voltage ratings, it may be necessary that fifth resistor 360 be realized by multiple series-connected resistors. Sixth resistor 364 is coupled between third node 362 and drain 344 of first transistor 340. Seventh resistor 366 is coupled between drain 344 of first transistor 340 and drain 354 of second transistor 350. Third transistor 370 has a gate 372, a drain 374, and a source 376; gate 372 is coupled to third node 362, and source 376 is coupled to circuit ground 60. Ninth resistor 378 is coupled between the DC voltage supply (+15 V) and drain 374 of third transistor 370. Fourth transistor 380 has a base 382, an emitter 384, and a collector 386; base 382 is coupled to drain 374 of third transistor, and collector 386 is coupled to the DC voltage supply (+15 V). Tenth resistor 388 is coupled between emitter 384 of fourth transistor 380 and circuit ground 60. Finally, third diode 390 has an anode 392 coupled to emitter 384 of fourth transistor 380 and a cathode 394 coupled to output 306.

The detailed operation of fault detection circuit 300 is now explained with reference to FIG. 3 as follows.

Resistors 360,364,366,368 and third transistor 370 work together to provide a shutdown command when the voltage across resonant capacitor 220 exceeds its normal operating value by a certain amount. More specifically, a shutdown command will be issued when the voltage at third node 362 (which is simply a scaled-down version of the voltage across resonant capacitor 220) is high enough to turn on transistor 370.

Resistors 378,388, fourth transistor 380, and third diode 390 function as an output stage that, in response to turn on of third transistor 370, deliver the shutdown signal (e.g., 15 volts) to output 306 and the shutdown input 132 of inverter driver circuit 130.

First diode 310, second diode 320, first resistor 328, second resistor 332, third resistor 334, fourth resistor 352, first transistor 340, and second transistor 350 work together to adjust the fault threshold in dependence on the current that flows through resonant capacitor 220 (which, in turn, depends on the type of lamps present in lamp load 30). More particularly:

(1) When the power of lamp load 30 is relatively high (e.g., F32T8 lamps), the current that flows into second input 304 will similarly be relatively high, thus providing voltages that are high enough to turn on both first transistor 340 and second transistor 350. Consequently, resistors 366,368 will both be shorted out, and the voltage at third node 362 will simply be the voltage across resistor 364. Under these conditions, third transistor 370 will turn on and issue a shutdown command only if the resonant capacitor voltage is relatively high (and, in any case, only if it is substantially higher than its normal operating value).

(2) When the power of lamp load 30 is somewhat lower (e.g., F25T8 lamps), the current that flows into second input 304 will be somewhat less than in the previous case, thus providing voltages that are sufficient to turn on second transistor 350 but not first transistor 340. Consequently, only resistor 368 will be shorted out, and the voltage at third node 362 will be the voltage across resistor 364 and resistor 366. Under these conditions, third transistor 370 will turn on and issue a shutdown command for somewhat lower values of the resonant capacitor voltage (as compared with the voltage that is required in the case of F32T8 lamps).

(3) When the power of lamp load 30 is even lower (e.g., F17T8 lamps), the current that flows into second input 304 will be even lower than in the previous case (i.e., when F25T8 lamps were present), thus providing voltages that are insufficient to turn on either first transistor 340 or second transistor 350. Consequently, neither of the resistors 366,368 will be shorted out, so the voltage at third node 362 will be the voltage across all three resistors 364,366,368. Under these conditions, third transistor 370 will turn on and issue a shutdown command for even lower values of the resonant capacitor voltage (as compared with the voltage that is required in the case of F25T8 lamps).

In this way, fault detection circuit 300 provides a fault threshold that is adjusted based on the type of lamps present in lamp load 30. Thus, fault detection circuit 300 is well suited for quickly protecting ballast 10 in the event of an emergent arcing condition in lamp load 30.

Although the present invention has been described with reference to certain preferred embodiments, numerous modifications and variations can be made by those skilled in the art without departing from the novel spirit and scope of this invention.

What is claimed is:

1. A ballast, comprising:

an inverter, comprising:

first and second input terminals adapted to receive a source of substantially direct current (DC) voltage;

an inverter output terminal;

an output circuit coupled to the inverter output terminal, the output circuit comprising first and second output connections for coupling to a lamp load comprising at least one gas discharge lamp;

a fault detection circuit coupled between the output circuit and the inverter, wherein the fault detection circuit is operable:

(i) to monitor a first signal and a second signal within the output circuit;

(ii) to set a fault threshold in dependence on the second signal; and (iii) in response to the first signal exceeding the fault threshold, to issue a shutdown command directing the inverter to cease operation.

2. The ballast of claim 1, wherein the second signal is indicative of the type of lamps in the lamp load.

3. The ballast of claim 1, wherein the fault threshold is set at:

(i) a first level in response to the second signal being less than a first predetermined value;

(ii) a second level that is greater than the first level in response to the second signal being greater than the first predetermined level but less than a second predetermined value; and (iii) a third level that is greater than the second level in response to the second signal being greater than the second predetermined level.

4. The ballast of claim 3, wherein the second signal is:

(i) less than the first predetermined level when the lamp load consists of F17T8 lamps;

(ii) greater than the first predetermined level but less than the second predetermined level when the lamp load consists of F25T8 lamps; and (iii) greater than the second predetermined level when the load consists of F32T8 lamps.

5. The ballast of claim 1, wherein the fault detection circuit comprises:

first and second inputs coupled to the output circuit; and an output coupled to the inverter.

6. The ballast of claim 5, wherein:

the output circuit further comprises:

a resonant inductor coupled between the inverter output terminal and the first output connection; and a resonant capacitor coupled between the first output connection and the second input of the fault detection circuit; and the first input of the fault detection circuit is coupled to the first output connection of the output circuit.

7. The ballast of claim 6, wherein:

the first signal is indicative of the voltage across the resonant capacitor; and the second signal is indicative of the current flowing through the resonant capacitor.

8. The ballast of claim 5, wherein;

the inverter further comprises:

upper and lower inverter transistors; and an inverter driver circuit coupled to the upper and lower inverter transistors and operable to commutate the inverter transistors in a substantially complementary manner, the inverter driver circuit having a shutdown input, wherein the inverter driver circuit is operable, in response to receipt of the shutdown command at the shutdown input, to cease commutating the inverter transistors; and the output of the fault detection circuit is coupled to the shutdown input of the inverter driver circuit.

9. The ballast of claim 8, wherein the inverter further comprises:

a current sensing resistor coupled in series with the lower inverter transistor; and a diode having an anode coupled to the current sensing resistor and a cathode coupled to the shutdown input of the inverter driver circuit.

10. The ballast of claim 8, wherein the fault detection circuit further comprises:

a first diode having an anode coupled to circuit ground and a cathode coupled to the second input;

a second diode having an anode coupled to the second input and a cathode coupled to a first node;

a first resistor coupled between the first node and a second node;

a second resistor coupled between the second node and circuit ground;

a first transistor having a gate, a drain, and a source, the source being coupled to circuit ground;

a third resistor coupled between the second node and the gate of the first transistor;

a second transistor having a gate, a drain, and a source, the source being coupled to circuit ground;

a fourth resistor coupled between the first node and the gate of the second transistor;

a fifth resistor coupled between the first input and a third node;

a sixth resistor coupled between the third node and the drain of the first transistor;

a seventh resistor coupled between the drain of the first transistor and the drain of the second transistor;

an eighth resistor coupled between the drain of the second transistor and circuit ground;

a third transistor having a gate, a drain, and a source, the gate being coupled to the third node and the source being coupled to circuit ground;

a ninth resistor coupled between a direct current (DC) voltage supply and the drain of the third transistor, a fourth transistor having a base, an emitter, and a collector, the base being coupled to the drain of the third transistor and the collector being coupled to the DC voltage supply;

a tenth resistor coupled between the emitter of the fourth transistor and circuit ground; and a third diode having an anode coupled to the emitter of the fourth transistor and a cathode coupled to the output.

11. A ballast, comprising:

an inverter, comprising:

first and second input terminals adapted to receive a source of substantially direct current (DC) voltage;

an inverter output terminal;

upper and lower inverter transistors; and an inverter driver circuit coupled to the upper and lower inverter transistors and operable to commutate the inverter transistors in a substantially complementary manner, the inverter driver circuit having a shutdown input wherein the inverter driver circuit is operable, in response to receipt of a shutdown command at the shutdown input, to cease commutating the inverter transistors;

a fault detection circuit, comprising:

first and second inputs;

an output coupled to the shutdown input of the inverter driver circuit;

an output circuit, comprising:

first and second output connections for coupling to a lamp load comprising at least one gas discharge lamp;

a resonant inductor coupled between the inverter output terminal and the first output connection, the first output connection being coupled to the first input of the fault detection circuit; and a resonant capacitor coupled between the first output connection and the second input of the fault detection circuit, the resonant capacitor having a resonant capacitor voltage and a resonant capacitor current; and wherein the fault detection circuit is operable:

(i) to monitor the resonant capacitor voltage and the resonant capacitor current;

(ii) to set a fault threshold in dependence on the resonant capacitor current; and (iii) in response to the resonant capacitor voltage exceeding the fault threshold, to send the shutdown command to the inverter driver circuit.

12. The ballast of claim 11, wherein the fault threshold is set at:

(i) a first level in response to the resonant capacitor current being less than a first predetermined value;

(ii) a second level that is greater than the first level in response to the resonant capacitor current being greater than the first predetermined level but less than a second predetermined value; and (iii) a third level that is greater than the second level in response to the resonant capacitor current being greater than the second predetermined level.

13. The ballast of claim 12, wherein the resonant capacitor current is:

(i) less than the first predetermined level when the lamp load consists of F17T8 lamps;

(ii) greater than the first predetermined level but less than the second predetermined level when the lamp load consists of F25T8 lamps; and (iii) greater than the second predetermined level when the load consists of F32T8 lamps.

14. The ballast of claim 11, wherein the inverter further comprises:

a current sensing resistor coupled in series with the lower inverter transistor; and a diode having an anode coupled to the current sensing resistor and a cathode coupled to the shutdown input of the inverter driver circuit.

15. The ballast of claim 1, wherein the fault detection circuit further comprises:

a first diode having an anode coupled to circuit ground and a cathode coupled to the second input;

a second diode having an anode coupled to the second input and a cathode coupled to a first node;

a first resistor coupled between the first node and a second node;

a second resistor coupled between the second node and circuit ground;

a first transistor having a gate, a drain, and a source, the source being coupled to circuit ground;

a third resistor coupled between the second node and the gate of the first transistor;

a second transistor having a gate, a drain, and a source, the source being coupled to circuit ground;

a fourth resistor coupled between the first node and the gate of the second transistor;

a fifth resistor coupled between the first input and a third node;

a sixth resistor coupled between the third node and the drain of the first transistor;

a seventh resistor coupled between the drain of the first transistor and the drain of the second transistor;

an eighth resistor coupled between the drain of the second transistor and circuit ground;

a third transistor having a gate, a drain, and a source, the gate being coupled to the third node and the source being coupled to circuit ground;

a ninth resistor coupled between a direct current (DC) voltage supply and the drain of the third transistor;

a fourth transistor having a base, an emitter, and a collector, the base being coupled to the drain of the third transistor and the collector being coupled to the DC voltage supply;

a tenth resistor coupled between the emitter of the fourth transistor and circuit ground; and a third diode having an anode coupled to the emitter of the fourth transistor and a cathode coupled to the output.

* * * * *